US005924302A

United States Patent [19]

Derifield

[11] Patent Number: 5,924,302

[45] Date of Patent: Jul. 20, 1999

[54] INSULATED SHIPPING CONTAINER

[75] Inventor: Rodney M. Derifield, Rancho Santa Margarita, Calif.

[73] Assignee: Foremost In Packaging Systems, Inc., Costa Mesa, Calif.

[21] Appl. No.: 08/826,275

[22] Filed: Mar. 27, 1997

[51] Int. Cl.[6] ..... F25D 3/08

[52] U.S. Cl. ..... 62/457.2; 62/371; 62/457.1; 62/60

[58] Field of Search ..... 62/457.2, 371, 62/457.1, 60

[56] References Cited

U.S. PATENT DOCUMENTS

| | | | |
|---|---|---|---|
| 2,632,311 | 3/1953 | Sullivan | 62/91.5 |
| 4,213,310 | 7/1980 | Buss | 62/457 |
| 4,344,300 | 8/1982 | Taylor | 62/457 |
| 4,344,301 | 8/1982 | Taylor | 62/457 |
| 4,903,493 | 2/1990 | Van Iperen et al. | 62/60 |
| 5,405,012 | 4/1995 | Shindler et al. | 206/569 |
| 5,429,264 | 7/1995 | Hollander et al. | 220/408 |
| 5,570,588 | 11/1996 | Lowe | 62/457.7 |
| 5,598,943 | 2/1997 | Markus | 220/410 |
| 5,669,233 | 9/1997 | Cook et al. | 62/371 |
| 5,671,611 | 9/1997 | Quigley | 62/457.7 |

FOREIGN PATENT DOCUMENTS

| | | |
|---|---|---|
| 2 649 381 | 1/1991 | France . |
| 25 05 203 A1 | 8/1976 | Germany . |
| 91 10 483 U1 | 11/1991 | Germany . |
| 296 04 325 U1 | 5/1996 | Germany . |
| 297 15 680 U1 | 10/1997 | Germany . |

*Primary Examiner*—Henry Bennett
*Assistant Examiner*—Mark Shulman
*Attorney, Agent, or Firm*—Lyon & Lyon LLP

[57] ABSTRACT

An improved shipping container including an insulated body having a cavity for holding a product being shipped, and having one or more cavities for holding coolant in a predetermined relationship to the product. The container also includes an insulated cover adapted to sealably engage an open end of the insulated body after a product and coolant are received therein. The cover includes one or more blocks or prongs extending therefrom that are adapted to slidably engage the coolant cavities and/or the product cavity to substantially minimize air spaces in the cavities and/or seal them. The insulated body and cover preferably are formed from injection molded polyurethane, wrapped in a plastic film and inserted into a cardboard shipping carton.

27 Claims, 6 Drawing Sheets

INSULATED SHIPPING CONTAINER

FIELD OF THE INVENTION

The present invention relates generally to shipping containers, and more particularly to an insulated shipping container having a plurality of cavities therein for holding a temperature sensitive product and coolant in a predetermined relationship to maintain a refrigerated condition for an extended period of time.

BACKGROUND

Traditionally, containers for shipping temperature sensitive products have generally included conventional cardboard shipping cartons having an insulating material therein, such as expanded polystyrene (EPS). EPS is a relatively inexpensive insulating material that may be easily formed into a desired shape, and has acceptable thermal insulating properties for many shipping needs.

Containers including EPS are often provided in a modular form. Individual panels of EPS insulation, possibly wrapped in foil or the like, are preformed using conventional methods, typically with beveled edges. The panels are then inserted into a conventional shipping carton against each wall to create an insulated cavity within the carton, the beveled edges of adjacent panels forming seams along the corners of the carton. A product is placed in the cavity and a plug, such as a thick polyether or polyester foam pad, is placed over the top of the product before the carton is closed and prepared for shipping. In many cases, a coolant, such as packaged ice, gel packs, or loose dry ice, is placed around the product in the cavity to refrigerate the product during shipping.

Alternatively, an insulated body may be injection molded from expanded polystyrene, forming a cavity therein and having an open top to access the cavity. A product is placed in the cavity, typically along with coolant, and a cover is placed over the open end, such as the foam plug described above or a cover formed from EPS.

For shipping particularly sensitive products, such as certain medical or pharmaceutical products, rigid polyurethane containers are often used, as polyurethane has thermal properties generally superior to EPS. Typically, a cardboard carton is provided having a box liner therein, defining a desired insulation space between the liner and the carton. Polyurethane foam is injected into the insulation space, substantially filling the space and generally adhering to the carton and the liner. The interior of the box liner provides a cavity into which a product and coolant may be placed. A foam plug may be placed over the product, or a lid may be formed from polyurethane, typically having a flat or possibly an inverted top-hat shape.

Conventional insulated shipping containers have many problems, particularly when shipping temperature sensitive products for extended periods of time, such as when products are shipped internationally. These containers, especially the modular liner systems, often include a number of seams in the insulating material through which air can enter and heat the cavity in the carton. In addition, the cavity often includes air spaces around the product and coolant which can facilitate convection, especially if the insulating material includes leaking seams. These conditions may accelerate the melting of the coolant, consequently shortening the time that the container can maintain a refrigerated condition. In addition, the cover or plug may be formed from a different material, such as polyester foam, which may have a thermal resistance substantially lower than the body itself, and thus may compromise the performance of the container.

Furthermore, the product and coolant are typically placed together within the cavity in the carton, which may have several adverse effects. When shipping certain products, it may be desired to refrigerate but not freeze the product. Placing a coolant, such as loose blocks of dry ice, into the cavity against the product may inadvertently freeze and damage the product. Even if held away from the product, the coolant may shift in the cavity during shipping, especially as it melts and shrinks in size, inadvertently contacting the product. In addition, melted coolant may leak from its container, possibly creating a mess within the cavity or even contaminating the product being shipped.

Finally, polyurethane containers may also create a disposal problem. When polyurethane is injected into a carton, it generally adheres substantially to the walls of the carton. Thus, the cardboard and insulation components may have to be disposed of together, preventing recycling of the container.

Accordingly, there is a need for an improved shipping container to maintain temperature sensitive material in a refrigerated condition for an extended period of time.

SUMMARY OF THE INVENTION

The present invention is directed generally to an improved insulated shipping container for shipping a temperature sensitive product in a refrigerated condition for an extended period of time. The container includes an insulated body having a cavity in it for holding a product being shipped, and includes one or more cavities for holding coolant in a predetermined relationship to the product cavity. An open end of the body provides access to the cavities, allowing a product and coolant to be placed in the respective cavities. The container also includes an insulated cover to close the open end of the body once the product and coolant are placed therein. Preferably, the cover includes insulated blocks extending from the cover that slide into and substantially fill any remaining space in the cavities when the cover is placed over the open end.

Generally, the insulated body and cover are formed from a substantially rigid insulating material having a relatively low thermal conductivity and being relatively light weight. Preferably, the insulated body and cover are formed from injection molded rigid polyurethane, wrapped in a film of plastic or the like, allowing the body and cover to be removably inserted into a conventional cardboard shipping carton.

In a first preferred embodiment in accordance with the present invention, the shipping container includes a substantially rectangular insulated body having four side walls, a bottom wall, and an open top defining a product cavity, the walls having a predetermined thickness to thermally insulate the product cavity. In addition, the product cavity preferably has a shape that allows a product to be securely held during shipping and/or handling, and that substantially minimizes air spaces around the product.

One or more of the side walls include a coolant cavity therein, generally extending adjacent the product cavity from the open top towards the bottom wall. Preferably, two opposite side walls each include a coolant cavity, and more preferably, all four side walls have coolant cavities in them adjacent the product cavity. Generally, the coolant cavities have a shape for receiving a conventional coolant, such as packaged ice, gel packs, or blocks of dry ice, preferably having a shape to securely hold the coolant in position and to minimize remaining air spaces around the coolant.

The container also includes an insulated cover for closing and substantially sealing the open end of the insulated body, preferably by cooperating tongues and grooves integrally formed around the perimeter of the cover and the body. The cover also includes one or more insulated blocks extending from and preferably integrally molded to the cover. The blocks have a shape and location on the cover allowing them to be inserted into the coolant cavities when the cover is placed over the open end of the insulated body. Preferably, the blocks slidably engage the walls of the coolant cavities and abut the coolant placed therein, thereby substantially minimizing any remaining air spaces above the coolant and substantially sealing the cavities. In addition, the cover may include an insulated block for insertion into the product cavity to similarly minimize air space remaining above the product placed therein. The insulated blocks, together with the shaped cavities, substantially reduce convection and leakage within the container, and thereby may substantially extend the effective time period that a product may be shipped in a refrigerated condition using the container.

Although the insulated body and cover may be used to ship temperature sensitive products without additional packaging, the body is preferably inserted into a conventional cardboard shipping carton, such that the outer surfaces of the body substantially engage the inside walls of the carton. A product and coolant are placed in the body, the cover is placed over the open end, substantially sealing the body. The carton may then be closed and prepared for shipping in a conventional manner.

As described above, the coolant cavities in the insulated body are substantially isolated from the product cavity. Generally, this orientation allows a product to be shipped in a refrigerated, but not frozen, condition, the portion of the side walls between the coolant and product cavities partially insulating the product from the temperatures of the coolant.

In a second preferred embodiment, a passage extends between each coolant cavity and the product cavity, preferably having a shape that allows the walls of the coolant cavity to securely hold the coolant therein, yet place the coolant in close proximity to the product within the product cavity. This orientation exposes the product more directly to the temperature of the coolant, thereby maintaining the product in a substantially frozen condition. For example, if dry ice is placed in the coolant cavity, it may be possible to freeze a product being shipped in the container at temperatures of around −60° Celsius or less for an extended time.

Accordingly, a principal object of the present invention is to provide an improved shipping container in which seams and air spaces are substantially minimized, thereby maximizing the period of time during which a product being shipped may be refrigerated.

It is also an object to provide an improved shipping container in which coolant is substantially held in a predetermined relationship to a product shipped in the container.

Other objects and features of the present invention will become apparent from consideration of the following description taken in conjunction with the accompanying drawings.

DETAILED DESCRIPTION OF THE PREFERRED EMBODIMENTS

Figure 1:
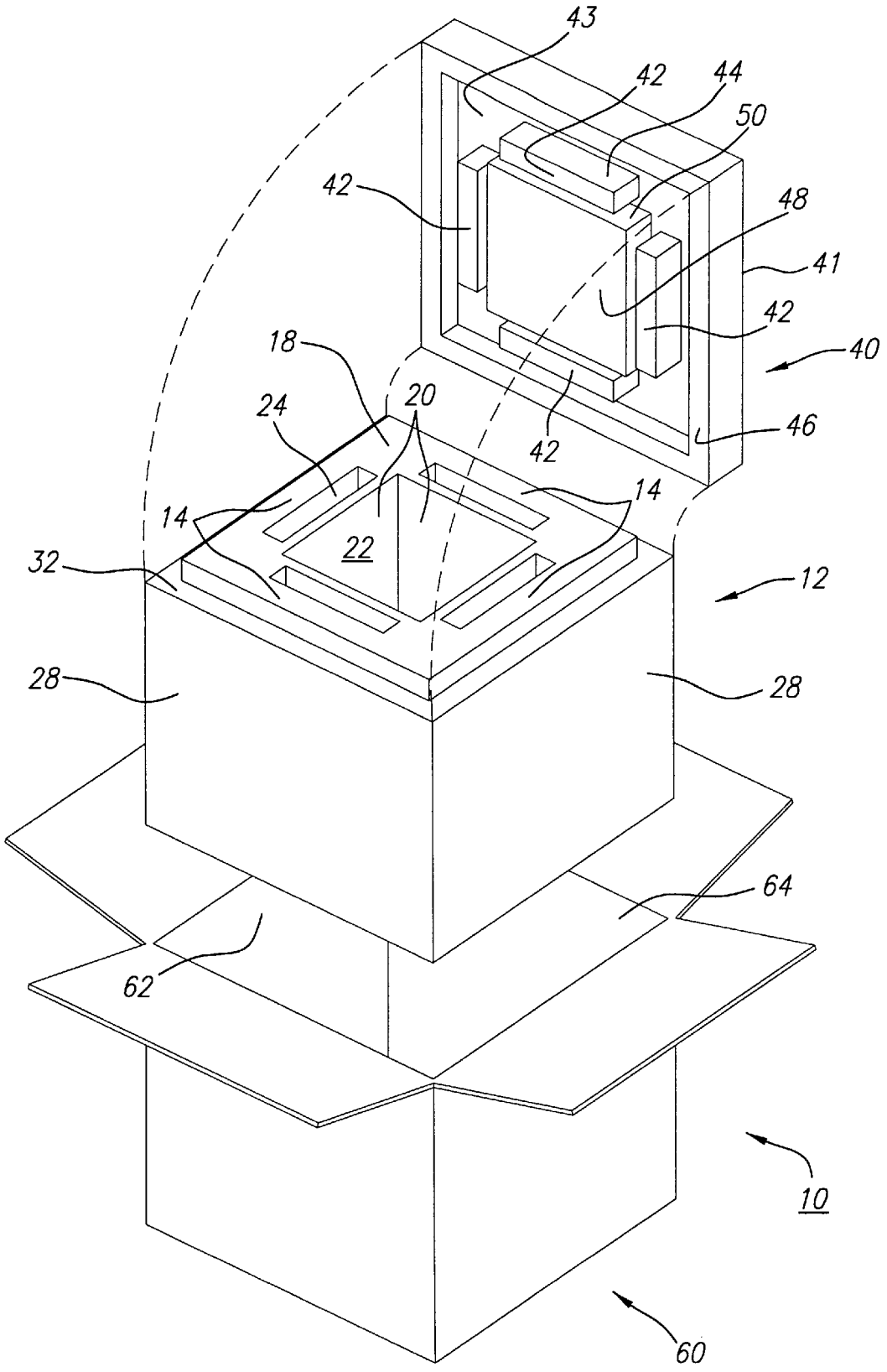
FIG. 1 is an exploded perspective view of a first preferred embodiment of an insulated shipping container in accordance with the present invention.

Turning now to the drawings, FIGS. 1–5 show a first preferred embodiment of an insulated shipping container 10 in accordance with the present invention. The container 10 generally includes a substantially rectangular insulated body 12, an insulated cover 40, and a shipping carton 60. The insulated body 12 has four side walls 14, a bottom wall 16 and an open top 18 defining a product cavity 22, the walls 14 and 16 having a predetermined thickness to thermally insulate the cavity 22. In addition, the product cavity 22 preferably has a shape that allows a product (not shown) to be placed in the body 12, the inner surfaces 20 of the side walls 14 preferably securely holding the product during shipping and/or handling, and substantially minimizing air spaces around the product.

Figure 3:
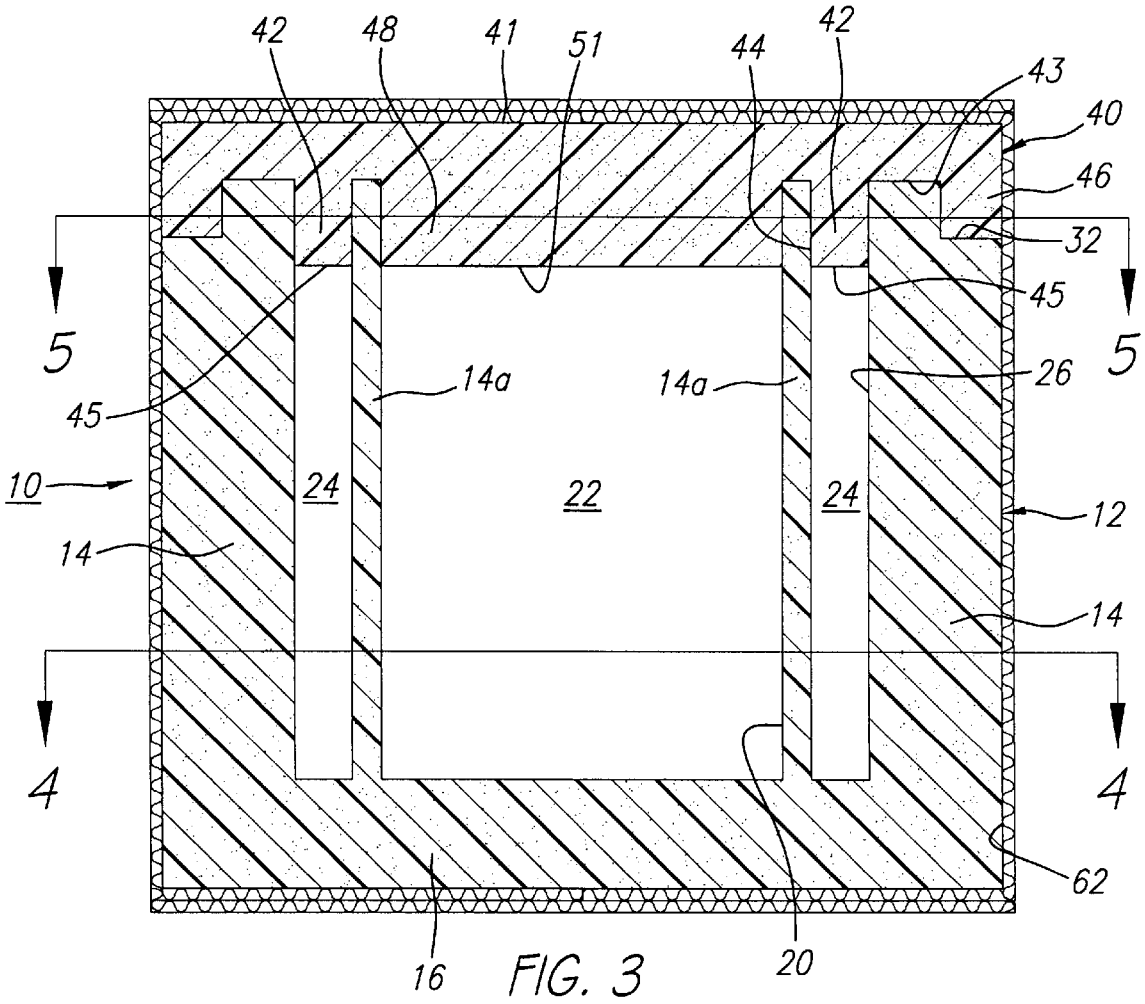
FIG. 3 is a cross-sectional view through the container of FIG. 2, taken along line 3—3.
Figure 4:
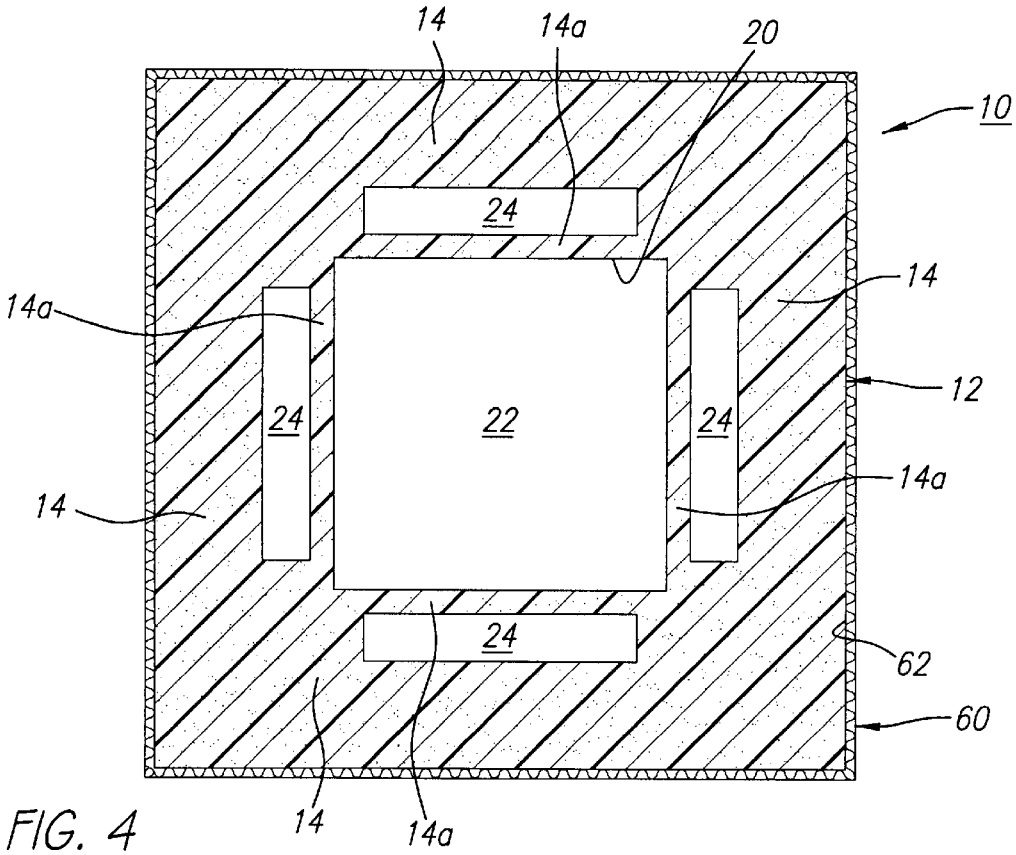
FIG. 4 is a cross-sectional view through the container of FIG. 3, taken along line 4—4.

Each of the four side walls 14 includes a coolant cavity 24 therein, generally extending adjacent the product cavity 22 from the open top 18 towards the bottom wall 16, as shown in FIGS. 3 and 4. Alternatively, only two opposite side walls 14 may include a coolant cavity 24. Generally, the inner surfaces 26 of the coolant cavities 24 have a shape adapted to receive a conventional coolant product (not shown), such as packaged ice, gel packs or other containers of frozen fluid, or loose blocks of dry ice, the inner surfaces 26 preferably having a shape to securely hold the coolant in position and to minimize remaining air spaces around the coolant. For example, dry ice may be available in 5 inch×5 inch×1 ½ inch blocks, and so for shipping applications in which dry ice is used, the coolant cavities 24 may have width and height dimensions that are multiples of 5 inches, thereby allowing them to securely hold such blocks of dry ice and substantially minimize voids or air spaces between the blocks.

Figure 5:
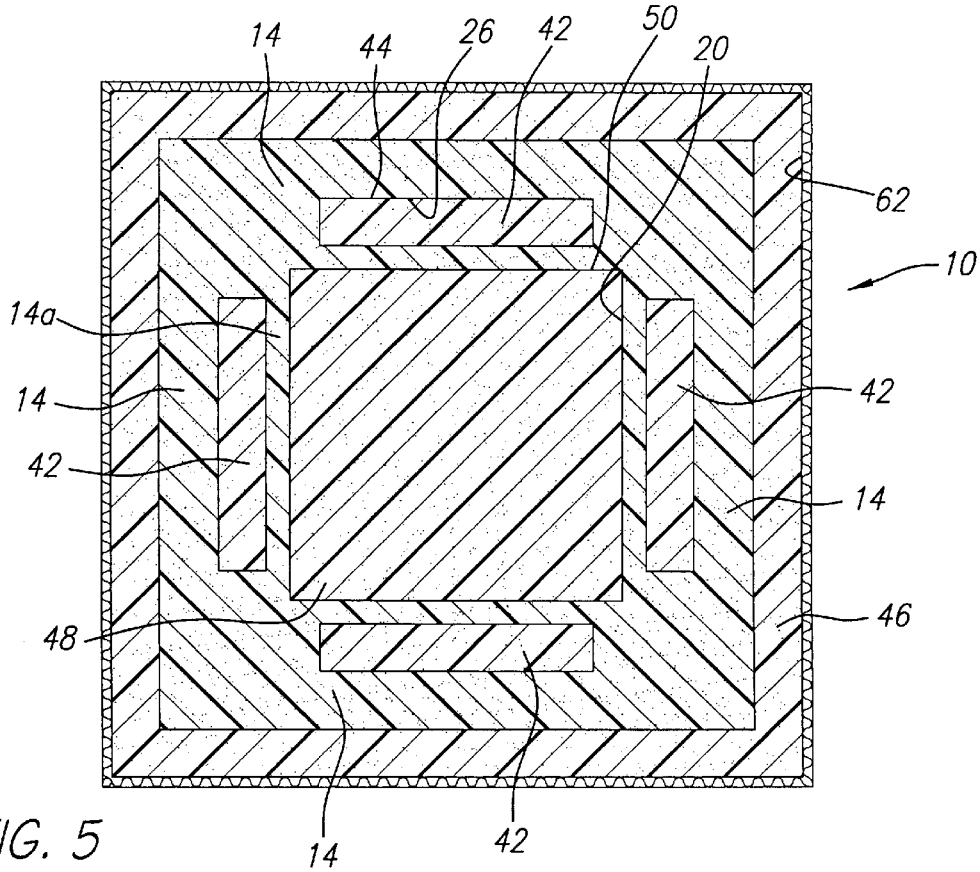
FIG. 5 is a cross-sectional view through the container of FIG. 3, taken along line 5—5.
Figure 6:
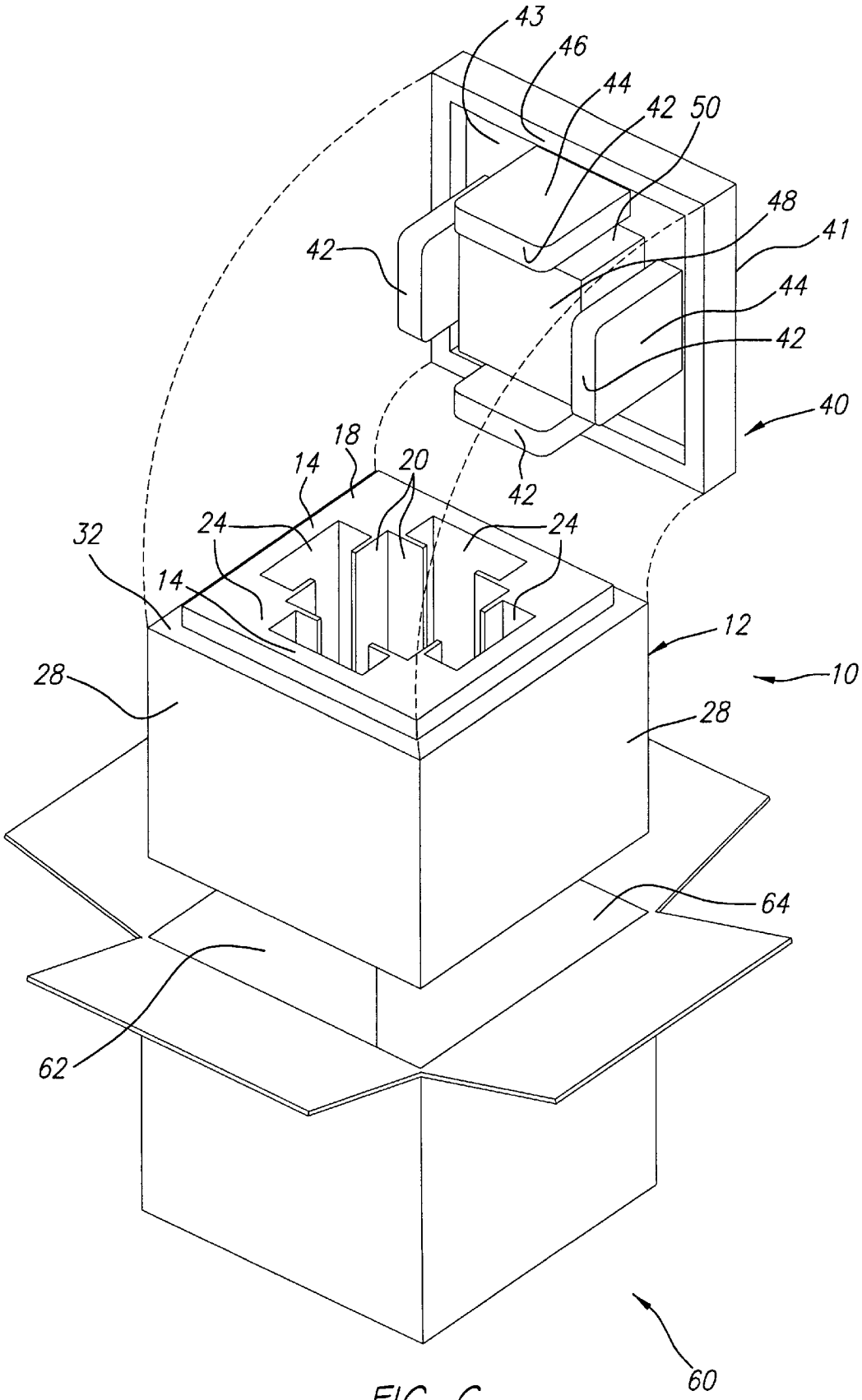
FIG. 6 is an exploded perspective view of a second preferred embodiment of an insulated shipping container in accordance with the present invention.
Figure 7:
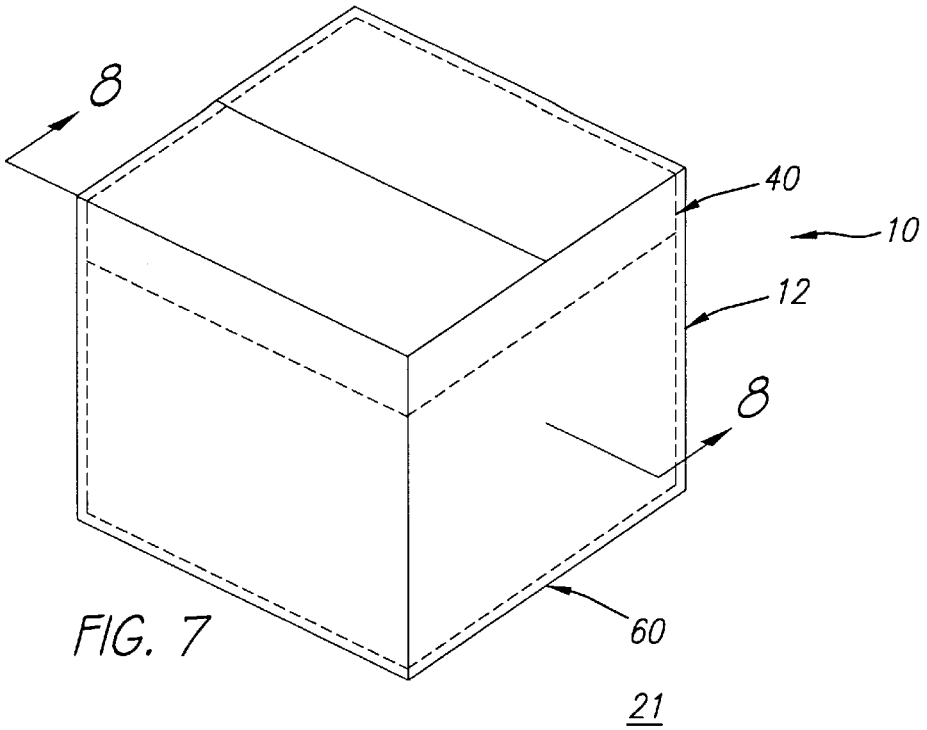
FIG. 7 is a perspective view of the container of FIG. 6 with the carton closed.

As shown in FIGS. 1, 3 and 5, the insulated cover 40 has a substantially flat outer surface 41 and an inner surface 43 designed to close and substantially seal the open end 18 of the insulated body 12, for example by using cooperating tongues and grooves. Preferably, the cover 40 includes a tongue 46 extending from and preferably integrally molded around the perimeter of the inner surface 43, while the body 12 includes a similarly shaped groove 32 extending around the perimeter of the open end 18. When the cover 40 is placed over the open end 18, the tongue 46 and groove 32 sealably engage one another, thereby substantially minimizing air leaking between the cavities 22 and 24 in the body 12 and the exterior of the container 10.

The cover 40 also includes four insulated blocks or prongs 42 extending from and preferably integrally molded to its inner surface 43. The blocks 42 correspond to respective coolant cavities 24 and have a shape and location on the cover 40 allowing them to be inserted into the coolant cavities 24 when the cover 40 is placed over the open end 18 of the body 12. Preferably, the outer surfaces 44 of the blocks 42 slidably engage the inner surfaces 26 of the coolant cavities 24, substantially sealing the cavities 24. In addition, the blocks 42 have a predetermined height, whereby the blocks 42 substantially engage or abut the top of the coolant (not shown) placed in the cavities 24, thereby holding the coolant in place during shipping, and substantially minimizing any remaining air space above the coolant when the cover 40 is in place. For example, the coolant may extend from the bottom of the cavity 24 to the top thereof and engage surface 45 of the block 42 when the cover 40 is on the body 12.

In addition, the cover 40 includes another insulated block 48 for insertion into the product cavity 22. Preferably, the outer surfaces 50 of the block 48 slidably engage the inner walls 20 of the product cavity 22 to substantially seal the cavity 22 when the cover 40 is placed over the open end 18. The block 48 also has a predetermined height to substantially engage or abut the top of the product (not shown) placed in the cavity 22, holding it in place during shipping and substantially minimizing the air space remaining above the product.

Figure 2:
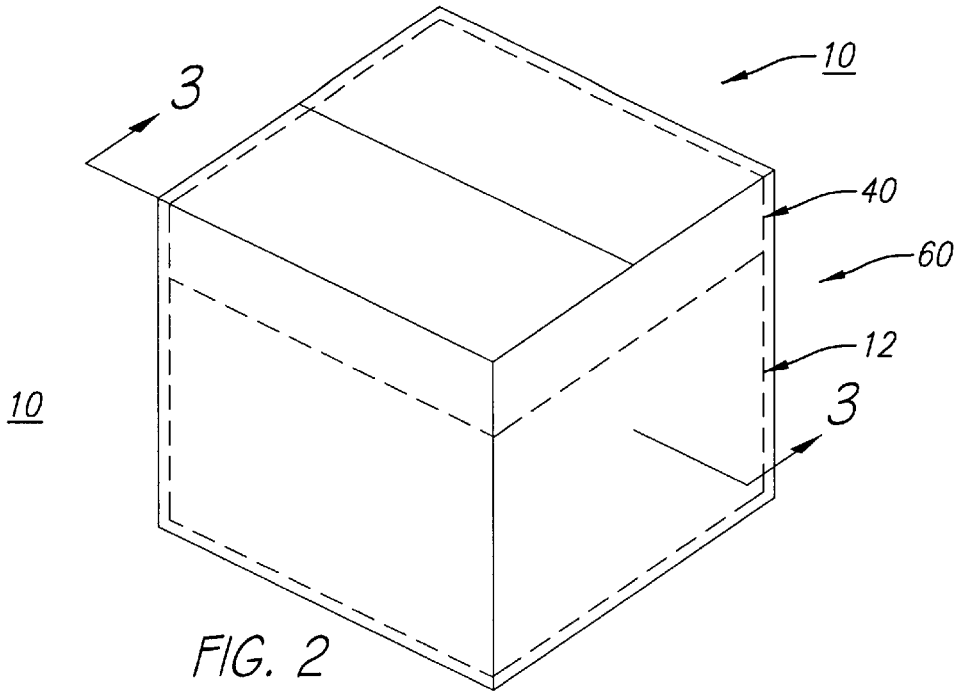
FIG. 2 is a perspective view of the container of FIG. 1 with the carton closed.

Prior to use, the insulated body 12 is preferably inserted into a conventional cardboard shipping carton 60, the outer surfaces 28 of the insulated body 12 substantially engaging the inside of the walls 62 of the carton 60, and the open end 18 of the body 12 corresponding to the open end 64 of the carton 60. After a product and coolant are placed in the respective cavities 22 and 24, the insulated cover 40 is placed over the open end 18, substantially sealing the insulated body 12. The carton 60 may then be closed and prepared for shipping in a conventional manner, as shown in FIG. 2.

As should be readily apparent from FIGS. 3 and 4, the container 10 includes coolant cavities 24 in the insulated body 12 that are substantially isolated from the product cavity 22. Generally, this orientation is preferred for shipping a product under refrigerated, but not frozen, conditions. The portions 14*a* of the side walls 14 between the coolant cavities 24 and the product cavity 24 partially insulate the product from the temperatures of the coolant, thereby protecting the product from being frozen as it would if in more direct contact with the coolant. In addition, when the cover 40 engages the open end 18 of the body 12, the blocks 42 and 48 substantially seal the cavities 24 and 22 respectively. This substantially eliminates the chance of coolant migrating during shipping and/or handling from the coolant cavities 24 to the product cavity 22 where it may contact and freeze the product.

The blocks 42 and 48 are important features of containers in accordance with the present invention for other reasons as well. The blocks 42 and 48 substantially abut the coolant and product respectively, substantially minimizing undesired movement during shipping and/or handling of the container 10. In addition, the blocks 42 substantially retain melted or leaking coolant within the coolant cavities 24, substantially preventing it from entering the product cavity 22 where it may possibly contaminate the product therein.

Most importantly, the blocks 42 and 48 substantially fill any remaining air spaces after the coolant and product are placed in the respective cavities 24 and 22, and help substantially seal the body 12 and the cover 40. Air spaces within the cavities may accelerate the melting of the coolant, and substantially reduce the duration of effective refrigeration of the product, particularly if seams allow air to leak into the cavities. The blocks 42 and 44 substantially eliminate these undesired conditions, thereby substantially extending the effective period of refrigeration for the container 10.

Generally, the insulated body 12 and cover 40 are formed from a substantially rigid insulating material having a relatively low thermal conductivity and being relatively light weight, such as expanded polystyrene, polyurethane, rigid polyurethane, or other foam insulation products. Preferably, the insulated body 12 and cover 40 are formed from rigid polyurethane, formed using conventional injection molding processes that should be familiar to those skilled in the art. In addition, the insulated body 12 and cover 40 are preferably covered by a thin film (not shown) during manufacturing to prevent the polyurethane from adhering substantially to the carton 60. The film may include a thin plastic or foil liner, such as polyethylene, that are laid up in the molding tools used to form the body 12 and the cover 40. After polyurethane is injected into the molding tool, the polyurethane cures and adheres to the film, rather than to the tool, facilitating removal. The film also facilitates insertion and removal of the body 12 and cover 40 from the carton 60. This allows the materials of the shipping container 10 to be more easily separated and recycled after use.

Turning now to FIGS. 6–10, a second preferred embodiment of an insulated shipping container 10 in accordance with the present invention is shown. Similar to the previous embodiment, the container includes an insulated body 12, an insulated cover 40, and a shipping carton 60. The body 12 has a product cavity 22 defined by the side walls 14 and the bottom wall 16 thereof. Four coolant cavities 24 are located adjacent the product cavity 22 and extend from the open end 18 of the body 12 towards the bottom wall 16.

Figure 8:
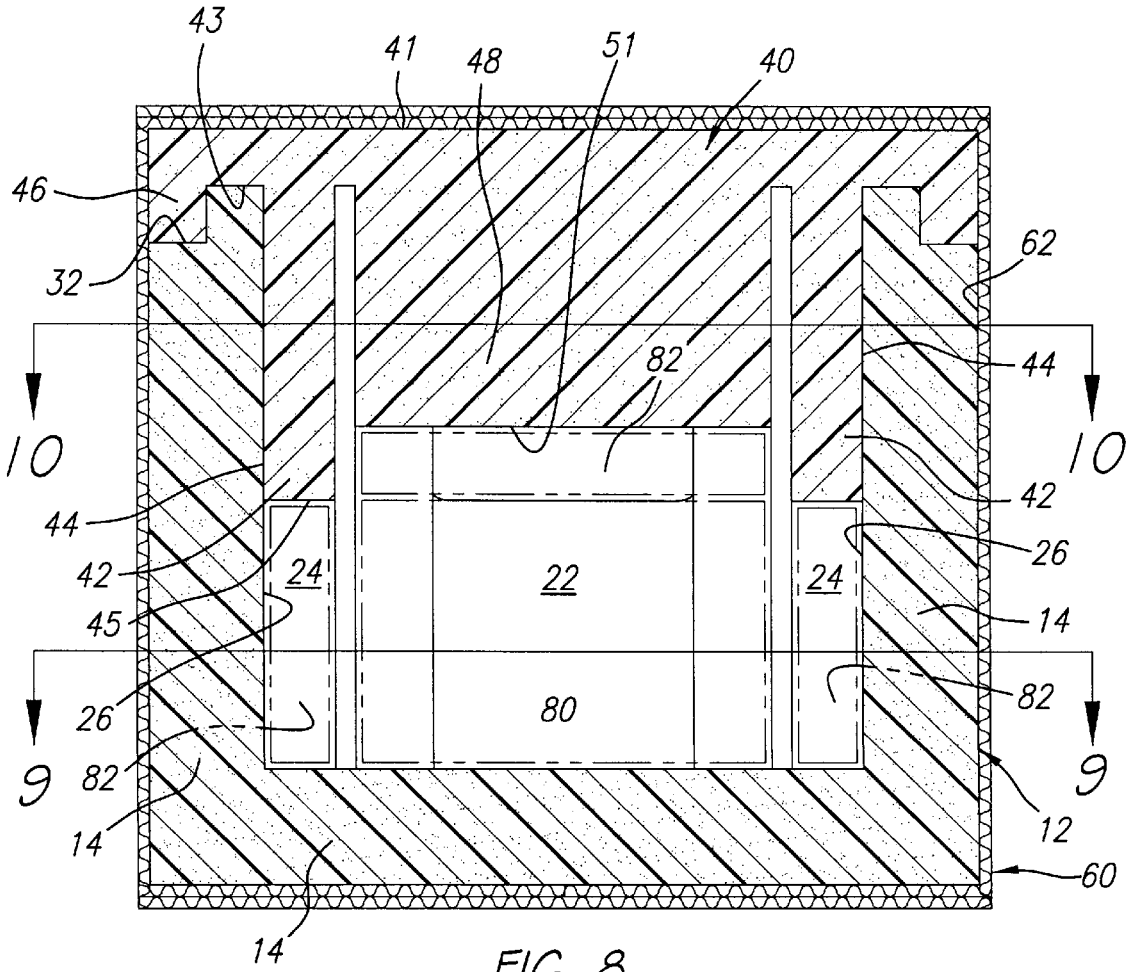
FIG. 8 is a cross-sectional view through the container of FIG. 7, taken along line 8—8.
Figure 9:
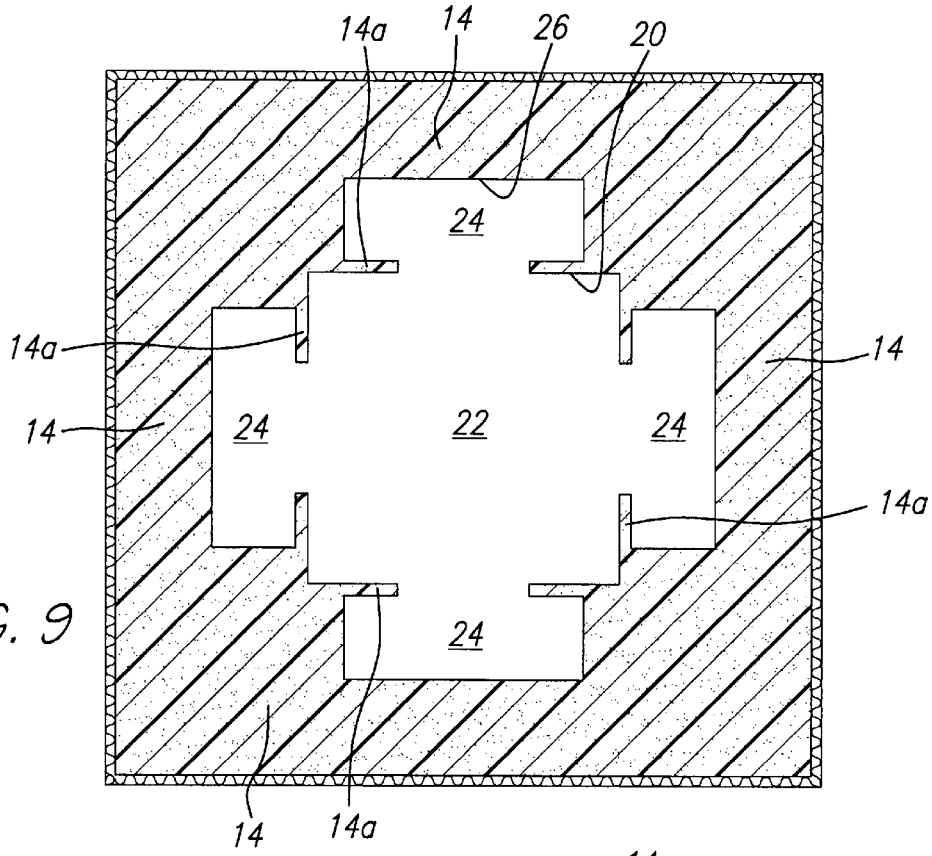
FIG. 9 is a cross-sectional view through the container of FIG. 8, taken along line 9—9.
Figure 10:
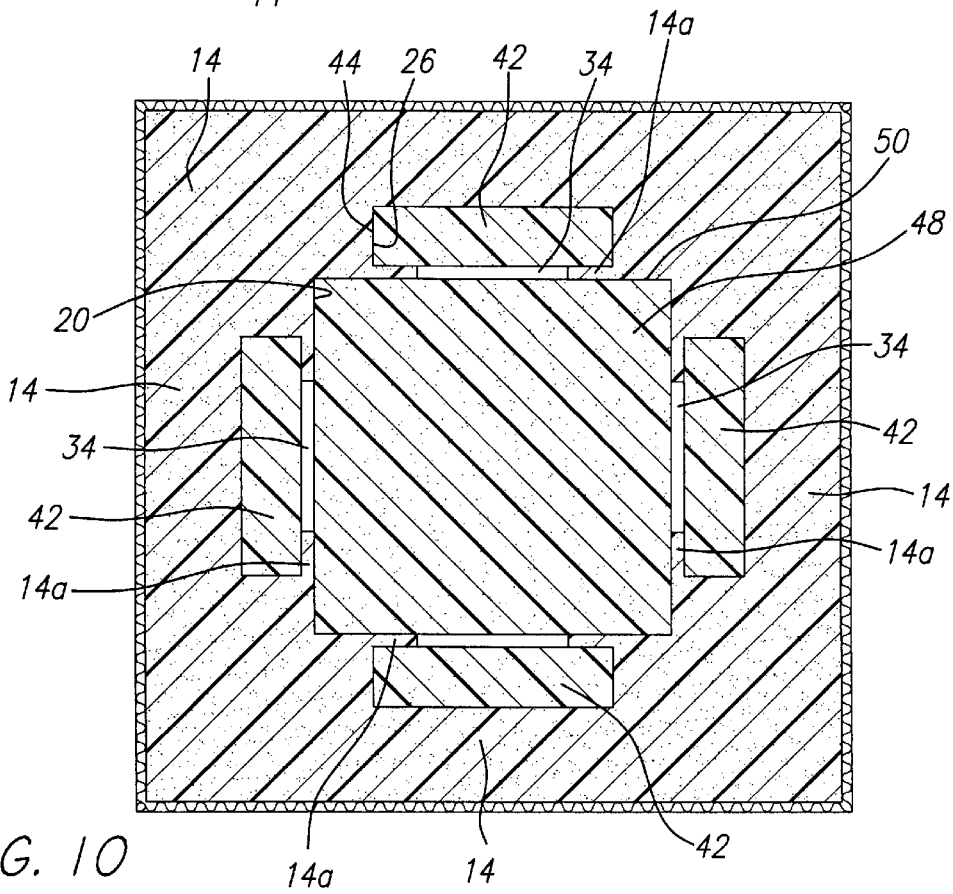
FIG. 10 is a cross-sectional view through the container of FIG. 8, taken along line 10—10.

Unlike the previous embodiment, a passage 34 extends through a portion 14*a* of the side walls 14 between each coolant cavity 24 and the product cavity 22. Preferably, the passages 34 have a shape that allows the inner surfaces 26 of the coolant cavities 24 to securely hold the coolant 82 (shown in phantom) therein, yet place the coolant 82 in close proximity to the product 80 (shown in phantom) within the product cavity 22. This orientation exposes the product 80 more directly to the temperatures of the coolant 82, thereby allowing the product 80 to be maintained in a substantially frozen condition. To reinforce a freezing condition, the insulated product block 48 may have a reduced height, thereby allowing an additional coolant 82 to be placed directly on top of the product 80, as shown in FIG. 8. For example, if dry ice is placed in the coolant cavities 24 and on top of the product 80, it may be possible to freeze the product 80 at temperatures of about −60° Celsius or less for an extended time.

As should be appreciated by those skilled in the art, the embodiments described are only exemplary of the possible configurations of insulated shipping containers in accordance with the present invention. The flexibility of the injection molding process allows the configuration of the insulated body and the corresponding cover to be easily changed to accommodate a variety of desired shipping conditions within the product cavity. For example, the side walls of the insulated body may include any number of coolant cavities placed in a predetermined relationship to the product cavity, with or without passages communicating between the cavities.

In addition, embodiments including a fixed number of coolant cavities (e.g. a container having four coolant cavities) may have one or more coolant cavities filled with polyurethane plugs when only some of the those cavities (e.g. two) are required to hold coolant to maintain a desired shipping condition. The plugs should have a shape similar to the coolant typically received in the cavities being plugged, thereby substantially eliminating any undesired air space within the body.

The side walls may also have a variety of thicknesses to provide a predetermined thermal insulation for the container as a whole, and/or to fit into a variety of commercially available cartons. In addition, the thickness of the portions of the side walls between the coolant cavities and the product cavity may be varied to adjust the temperature to which the product cavity and product therein are exposed. In addition, the shape and size of the product cavity may be adapted to accommodate a variety of products, possibly forming a plurality of product cavities in the insulated body for shipping multiple products simultaneously. Thus, containers in accordance with the present invention may be used to safely ship a number of products in which a desired refrigerated or frozen condition is to be maintained for an extended period of time, such as pharmaceuticals, biotechnology products, blood or tissue, cryogenic products, frozen foods, adhesives or sealants, and other similar products.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the spirit and scope of the appended claims.

What is claimed is:

1. An insulated shipping container for transporting a temperature sensitive product therein, the container comprising:

an insulated body having a product cavity and a coolant cavity therein, and having an open end for accessing the cavities, the product cavity having a shape adapted to receive a product to be transported therein, the coolant cavity being located adjacent the product cavity and having a shape adapted to receive coolant therein; and an insulated cover adapted to engage the open end of the insulated body, the insulated cover including an insulated coolant block extending therefrom, the insulated coolant block slidably engaging the coolant cavity when the insulated cover engages the open end, thereby substantially filling a remaining air space within the coolant cavity after coolant is received therein.

2. The insulated shipping container of claim 1, wherein the insulated body includes a passage communicating between the product cavity and the coolant cavity.

3. The insulated shipping container of claim 1, wherein the insulated body and the insulated cover include cooperating tongues and grooves adapted to substantially seal the container when the insulated cover engages the open end of the insulated body.

4. The insulated shipping container of claim 1, wherein the insulated cover includes an insulated product block extending therefrom, the insulated product block being adapted to slidably engage the product cavity when the insulated cover engages the open end, thereby substantially filling a remaining air space within the product cavity after a product is received therein.

5. The insulated shipping container of claim 1, wherein the insulated body comprises injection molded polyurethane.

6. The insulated shipping container of claim 1, wherein the insulated cover comprises injection molded polyurethane.

7. The insulated shipping container of claim 1, further comprising a shipping carton into which the insulated body is received.

8. An insulated shipping container for transporting a temperature sensitive product therein the container comprising:

an insulated body having a product cavity and a coolant cavity therein, and having an open end for accessing the cavities, the product cavity having a shape adapted to receive a product to be transported therein the coolant cavity being located adjacent the product cavity and having a shape adapted to receive coolant therein;

an insulated cover adapted to engage the open end of the insulated body, the insulated cover including an insulated coolant block extending therefrom the insulated coolant block slidably engaging the coolant cavity when the insulated cover engages the open end, thereby substantially filling a remaining air space within the coolant cavity after coolant is received therein; and a shipping carton into which the insulated body is received;

wherein the insulated body comprises molded polyurethane wrapped in a film, the film allowing the insulated body to be removably inserted into the shipping carton.

9. An insulated shipping container for transporting a temperature sensitive product for an extended period of time, the container comprising:

a substantially rectangular body comprising four side walls and a bottom wall defining a product cavity therein, and having an open top; at least one of the side walls including a coolant cavity therein, the coolant cavity being adapted to securely receive a coolant therein; and an insulated cover adapted to sealably engage the open top of the insulated body, the insulated cover including an insulated block extending therefrom, the insulated block being adapted to slidably engage the coolant cavity, thereby the coolant and the insulated block together substantially filling the coolant cavity.

10. The insulated shipping container of claim 9, wherein the insulated body comprises injection molded polyurethane integrally forming the side walls and the bottom wall.

11. The insulated shipping container of claim 9, wherein the insulated cover comprises injection molded polyurethane.

12. The insulated shipping container of claim 11, wherein the insulated block comprises injection molded polyurethane integrally molded to the insulated cover.

13. An insulated shipping container for transporting a temperature sensitive product for an extended period of time, comprising:

a substantially rectangular body comprising four side walls and a bottom wall defining a product cavity therein, and having an open top; at least one of the side walls including a coolant cavity therein, the coolant cavity being adapted to securely receive a coolant therein; and an insulated cover adapted to sealably engage the open top of the insulated body, the insulated cover including an insulated block extending therefrom the insulated block being adapted to slidably engage the coolant cavity, thereby the coolant and the insulated block together substantially filling the coolant cavity, wherein each of the four side walls includes a similarly shaped coolant cavity.

14. The insulated shipping container of claim 9, wherein the coolant cavity extends from the open top of the insulated body towards the bottom wall thereof substantially parallel to the product cavity, the coolant cavity being substantially isolated from the product cavity when the cover engages the open top of the insulated body.

15. The insulated shipping container of claim 9, further comprising a passage extending between the coolant cavity and the product cavity, thereby communicating the refrigerated condition of a coolant received in the coolant cavity directly to a product held in the product cavity.

16. An insulated shipping container for maintaining a product at a predetermined refrigerated condition for an extended period of time, the container comprising:

an insulated body having a plurality of walls defining a product cavity, the plurality of walls being adapted to substantially engage a product in the product cavity, thereby substantially minimizing air spaces around the product; and at least one of the walls having a coolant cavity therein adapted to receive coolant therein, the coolant cavity being spaced from and having a predetermined spatial relationship with the product cavity, thereby subjecting the product in the product cavity to a predetermined refrigerated condition.

17. An insulated shipping container for maintaining a product at a predetermined refrigerated condition for an extended period of time, comprising:

an insulated body having a plurality of walls defining a product cavity, the plurality of walls being adapted to substantially engage a product in the product cavity, thereby substantially minimizing air spaces around the product; and at least one of the walls having a coolant cavity therein adapted to receive coolant therein, the coolant cavity being spaced from and having a predetermined spatial relationship with the product cavity, thereby subjecting the product in the product cavity to a predetermined refrigerated condition, wherein the coolant cavity is adjacent to and substantially isolated from the product cavity, thereby partially insulating the product held in the product cavity from the coolant received in the coolant cavity.

18. An insulated shipping container for maintaining a product at a predetermined refrigerated condition for an extended period of time, comprising:

an insulated body having a plurality of walls defining a product cavity, the plurality of walls being adapted to substantially engage a product in the product cavity, thereby substantially minimizing air spaces around the product; and at least one of the walls having a coolant cavity therein adapted to receive coolant therein, the coolant cavity being spaced from and having a predetermined spatial relationship with the product cavity, thereby subjecting the product in the product cavity to a predetermined refrigerated condition, wherein one of the plurality of walls comprises a removable panel, providing access to the product and coolant cavities in the insulated body.

19. The insulated shipping container of claim 16, wherein the coolant comprises dry ice.

20. The insulated shipping container of claim 16, wherein the insulated body includes a passage extending between the coolant cavity and the product cavity, thereby directly exposing the product held in the product cavity to the temperature conditions of the coolant received in the coolant cavity.

21. The insulated shipping container of claim 9, wherein two opposite side walls include a similarly shaped coolant cavity.

22. An insulated shipping container for transporting a temperature sensitive product therein, comprising:

an insulated body having a product cavity therein, and an open end for accessing the product cavity, the product cavity having a predetermined shape for securely receiving a similarly shaped product;

an array of coolant cavities in the insulated body accessible from the open end, and having a predetermined spatial relationship with the product cavity, each coolant cavity having a predetermined shape for substantially securely receiving a similarly shaped coolant therein; and an insulated cover adapted to engage the open end of the insulated body and having a configuration for minimizing air spaces within the cavities;

whereby a product received in the product cavity is subjected to a predetermined refrigerated condition when coolant is received in the array of coolant cavities and the insulated cover substantially engages the open end of the insulated body.

23. The insulated shipping container of claim 22, wherein the array of coolant cavities comprises a pair of coolant cavities disposed opposite one another about the product cavity.

24. The insulated shipping container of claim 22, wherein the insulated cover includes an array of insulated blocks extending therefrom, each insulated block slidably engaging a respective coolant cavity when the insulated cover substantially engages the open end, thereby substantially filling a remaining air space within the respective coolant cavity after coolant is received therein.

25. An insulated shipping container for transporting a temperature sensitive product therein, comprising:

an insulated body having a product cavity therein, and an open end for accessing the product cavity, the insulated body comprising molded polyurethane wrapped in a film;

an insulated cover adapted to engage the open end of the insulated body; and a shipping carton into which the insulated body is received, the film of the insulated body allowing the insulated body to be removably inserted into the shipping carton.

26. The insulated shipping carton of claim 25, wherein the insulated cover comprises molded polyurethane wrapped in a film.

27. The insulated shipping carton of claim 25, wherein the insulated body further comprises one or coolant cavities in a predetermined relationship with the product cavity.

* * * * *

UNITED STATES PATENT AND TRADEMARK OFFICE

CERTIFICATE OF CORRECTION

PATENT NO. : 5,924,302
DATED : July 20, 1999
INVENTOR(S) : Rodney M. Derifield

It is certified that error appears in the above-identified patent and that said Letters Patent is hereby corrected as shown below:

Column 8,
Line 13, please change "therein the coolant" to -- therein, the coolant --.
Lines 18 and 64, please change "therefrom the insulated" to -- therefrom, the insulated --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*

Disclaimer

5,924,302—Rodney M. Derifield, Rancho Santa Margarita. Calif. INSULATED SHIPPING CONTAINER. Patent Dated July 20, 1999. Disclaimer filed June 13, 2005, by Assignee, FOREMOST IN PACKAGING SYSTEMS, INC.

Hereby enters this disclaimer to claims 25 and 26, of said patent.

*(Official Gazette, September 20, 2005)*